US009248549B2

(12) United States Patent
McIntyre

(10) Patent No.: US 9,248,549 B2
(45) Date of Patent: Feb. 2, 2016

(54) TWIN LINE WET ABRASIVE BLASTING SYSTEM

(71) Applicant: John McIntyre, Dunnville (CA)

(72) Inventor: John McIntyre, Dunnville (CA)

(73) Assignee: Graco Fluid Handling (B) Inc., Minneapolis, MN (US)

( * ) Notice: Subject to any disclaimer, the term of this patent is extended or adjusted under 35 U.S.C. 154(b) by 89 days.

(21) Appl. No.: 14/051,520

(22) Filed: Oct. 11, 2013

(65) Prior Publication Data

US 2014/0134931 A1 May 15, 2014

Related U.S. Application Data

(60) Provisional application No. 61/724,429, filed on Nov. 9, 2012.

(51) Int. Cl.

| | |
|---|---|
| ***B24C 7/00*** | (2006.01) |
| ***B24C 5/04*** | (2006.01) |
| ***B24C 5/02*** | (2006.01) |

(52) U.S. Cl.

CPC ..... *B24C 7/0084* (2013.01); *B24C 5/02* (2013.01); *B24C 5/04* (2013.01); *B24C 7/0092* (2013.01)

(58) Field of Classification Search

CPC ..... B24C 7/00–7/0092

USPC ..... 451/99, 100; 209/44.2, 134, 156

See application file for complete search history.

(56) References Cited

U.S. PATENT DOCUMENTS

| | | | | |
|---|---|---|---|---|
| 3,922,991 | A | 12/1975 | Woods | |
| 4,253,610 | A * | 3/1981 | Larkin | 239/430 |
| 4,821,961 | A * | 4/1989 | Shook | 239/253 |
| 5,169,065 | A | 12/1992 | Bloch | |
| 5,186,625 | A | 2/1993 | Bailey | |
| 6,402,593 | B1 * | 6/2002 | Shaw | 451/36 |
| 8,186,907 | B1 | 5/2012 | Asplin | |
| 2003/0003124 | A1 * | 1/2003 | Laughlin | 424/401 |
| 2010/0093262 | A1 | 4/2010 | Seyffert et al. | |

* cited by examiner

*Primary Examiner* — Monica Carter
*Assistant Examiner* — Lauren Beronja
(74) *Attorney, Agent, or Firm* — Kinney & Lange, P.A.

(57) ABSTRACT

The present concept a wet abrasive blasting system includes a splitter manifold receiving compressed air from a source of compressed air. The splitter manifold includes at least two passageways and also a manifold pre-nozzle associated with each passageway respectively. The splitter manifold communicates air through the passageways to corresponding air conduits which feed compressed air to at least two wet blasters respectively wherein the blasters each include an exit nozzle which are substantially the same or smaller in size than the pre-nozzles.

31 Claims, 3 Drawing Sheets

200
3
3
250
222
202
232
218
220
210
212
216
214
208
$L_B$
234

218
220
225
236

204
208
250
202
206
226
224
228
230
200

TWIN LINE WET ABRASIVE BLASTING SYSTEM

The application claims priority from previously filed U.S. provisional patent application Ser. No. 61/724,429 titled TWIN WET ABRASIVE BLASTING SYSTEM, which was filed on Nov. 9, 2012 by John McIntyre.

FIELD OF THE INVENTION

The system disclosed in this application is directed to compressed air abrasive blasting systems and more particularly is directed to a compressed air twin line wet abrasive blasting system.

BACKGROUND OF THE INVENTION

Dry and wet abrasive blasting systems consume vast amounts of compressed air. They have been used typically for cleaning operations, for preparing surfaces for painting, for removing rust, corrosion and coatings including paint and other coatings. In situations requiring blasting operations, that do not tolerate dry sandblasting conditions.

Wet abrasive blasting systems have been used typically in situations requiring blasting operations, that do not tolerate dry sandblasting conditions due to environmental or other factors.

A typical wet abrasive blasting system is described and depicted in U.S. patent application Ser. No. 13/080,880 filed by Keith Eliason on Apr. 6, 2011 under the title Wet Abrasive Blasting System and Method. The diagrams in that application depict typical wet abrasive blasting systems that have been in use for many decades.

The current wet abrasive blasting systems use a single air compressor to operate a single wet abrasive blasting system which in turn operates a single blasting wand and nozzle operated by a single operator.

Typically one of the most expensive capital items required to manufacture a dry or wet abrasive blasting system is the air compressor needed to produce the large amounts of volume of air consumed by a typical abrasive blasting system.

In order to improve the efficiency and to lower the cost of operation of abrasive blasting systems it is desirable to be able to operate two wet abrasive blasters using one air compressor thereby being able to reduce the capital cost and as well improve production efficiency.

The difficulty to date with using a single air compressor with two dry or wet blasters is the interference of the airflow from one wet blaster to the second wet blaster when for example the operator turns their exit nozzle on and off thereby creating pressure spikes and fluctuations within the system which create instability in the entire operation of the wet blasters.

Therefore it is desirable to have a twin wet abrasive blasting system which is capable of dampening out pressure spikes and fluctuations between two or more wet blasters which are connected to one air compressor in such a manner that both can run smoothly and efficiently.

SUMMARY

In combination a splitter manifold and at least two wet abrasive blasters:

a) the splitter manifold receiving compressed air from a source of compressed air and splitting an inlet air flow among a least two passageways defined within the splitter manifold;

b) each passageway including a pre-nozzle proximate an outlet end defining at least two compressed air outlets each having a defined cross sectional area;

c) the splitter manifold communicating air through the outlets to corresponding individual air conduits which feed compressed air to the at least two wet abrasive blasters respectively;

d) wherein the at least two wet abrasive blasters each include an exit nozzle which is substantially the same or smaller in cross sectional area than the corresponding pre-nozzle.

Preferably wherein the splitter manifold includes a cylindrical inlet expansion chamber at an inlet end for communicating compressed air to the passageways, the expansion chamber including an inlet diameter Di and an expanded diameter De wherein De substantially $\geq 2\times Di$.

Preferably wherein the expansion chamber further includes a baffle for directing the air flow into the passageways.

Preferably wherein the passageways are tubular and have length L such that length L is substantially $\geq 5$ Di.

Preferably wherein the passageways are tubular and have length L such that length L is substantially $\geq 10$ Di.

Preferably wherein the passageways are tubular and oriented along a longitudinal direction such that air flow through the passageways and inlet air flow and outlet air flow are all oriented along a longitudinal direction.

Preferably wherein the splitter manifold includes a body for housing the passageways with an expansion chamber attached at an inlet end and the body terminating at an outlet end.

Preferably wherein the splitter manifold includes a tubular body for housing the passageways with a tubular expansion chamber attached at an inlet end and the body terminating at an outlet end, the body oriented along a longitudinal direction.

Preferably wherein the passageways make contact with the body at a contact area which runs along the length of each passageway.

Preferably wherein the abrasive blasters are wet abrasive blasters.

A twin wet abrasive blasting system comprising;

a) a splitter manifold receiving compressed air from a source of compressed air;

b) the splitter manifold includes at least two passageways, each passageway receiving compressed air at an inlet end and terminating at a manifold pre-nozzle;

c) the splitter manifold communicating air through the passageways to corresponding air conduits which feed compressed air to at least two wet blasters respectively;

d) wherein the blasters each include an exit nozzle, wherein each exit nozzle is substantially the same cross sectional area or smaller in area than the pre-nozzles respectively.

Preferably wherein the splitter manifold is tubular and includes an inlet having an inlet diameter Di.

Preferably wherein the inlet is connected to an expansion chamber with an expanded diameter De at least two times the inlet diameter, the expansion chamber communicates compressed air from the inlet to the passageways.

Preferably wherein the passageways lengths Lt are each at least five times the inlet diameter.

Preferably wherein the passageways lengths Lt are each at least ten times the inlet diameter.

Preferably wherein the splitter manifold includes a body for housing the passageways.

Preferably wherein the body length is at least five times the inlet diameter.

Preferably wherein the body length is at least ten times the inlet diameter.

BRIEF DESCRIPTION OF THE DRAWINGS

The blasting system will now be described by way of example only with reference to the following drawings in which.

DETAILED DESCRIPTION OF THE PREFERRED EMBODIMENTS

Figure 7:
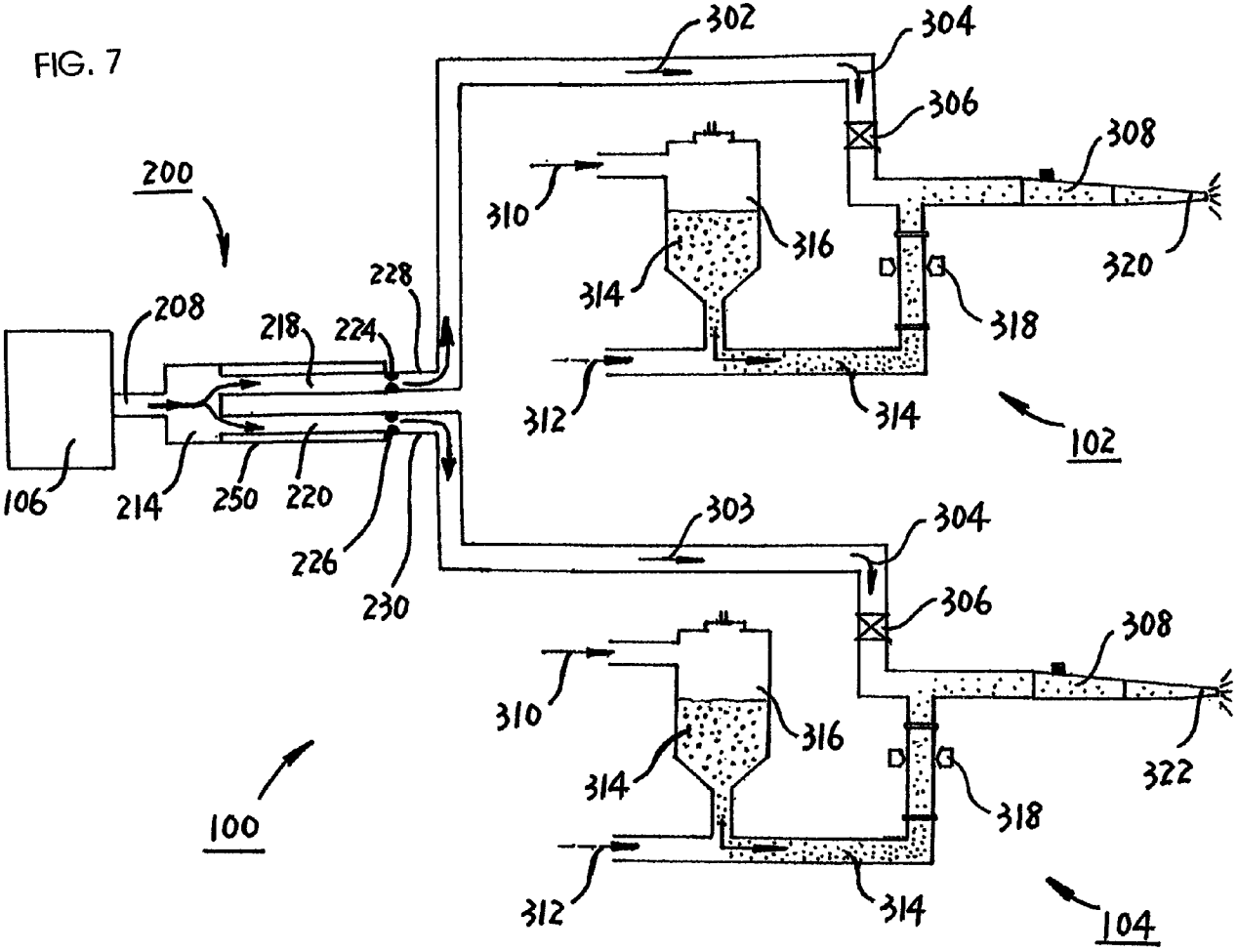
FIG. 7 is a schematic view of a twin wet abrasive blasting system shown with a splitter manifold and a single air compressor.

The present concept the twin wet abrasive blasting system is depicted in schematic flow fashion in FIG. 7 which shows the major components of the twin wet abrasive blasting system 100 including a first wet blaster 102, a second wet blaster 104, a splitter manifold 200 and a single air compressor 106. The reader will note that splitter manifold 200 feeds air to the first wet blaster 102 and second wet blaster 104 via a single air compressor 106.

Now referring to FIGS. 1 through 6 which show some details of splitter manifold 200.

The major components of splitter manifold 200 include housing 202 which has an inlet end 204 and an outlet end 206.

At inlet end 204 there is an inlet 208 connected to an inlet pipe 210 in communication with an inlet expansion chamber 214 which has an inlet cross sectional area corresponding to an inlet diameter Di 212 and an expanded cross sectional area corresponding to an expanded diameter De 216.

Inlet expansion chamber 214 is connected to body 250 having a length Lb 234.

Housed within body 250 is a first passageway 218 and a second passageway 220 each having length Lt 231 and running longitudinally along longitudinal direction 221 along the length Lb 234 of body 250. In order to minimize heat production inlet air flow 223, outlet air flow 227 and air flow through passageways 218 and 220 are all parallel to longitudinal direction 221.

At the inlet end there is a baffle 236 preventing air from entering into body 250 and forcing the air through first passageway 218 and second passageway 220.

At outlet end 206 of housing 202 there is a first manifold pre-nozzle 224 and a second manifold pre-nozzle 226 associated with first passageway 218 and second passageway 220 respectively as well as a first outlet 228 and a second outlet 230.

Additionally there are flanges 232 for mounting of the splitter manifold 200 in any desirable location.

Body 250 having a length Lb 234 also defines a volume V 222.

Figures 1, 2, 3, 4:
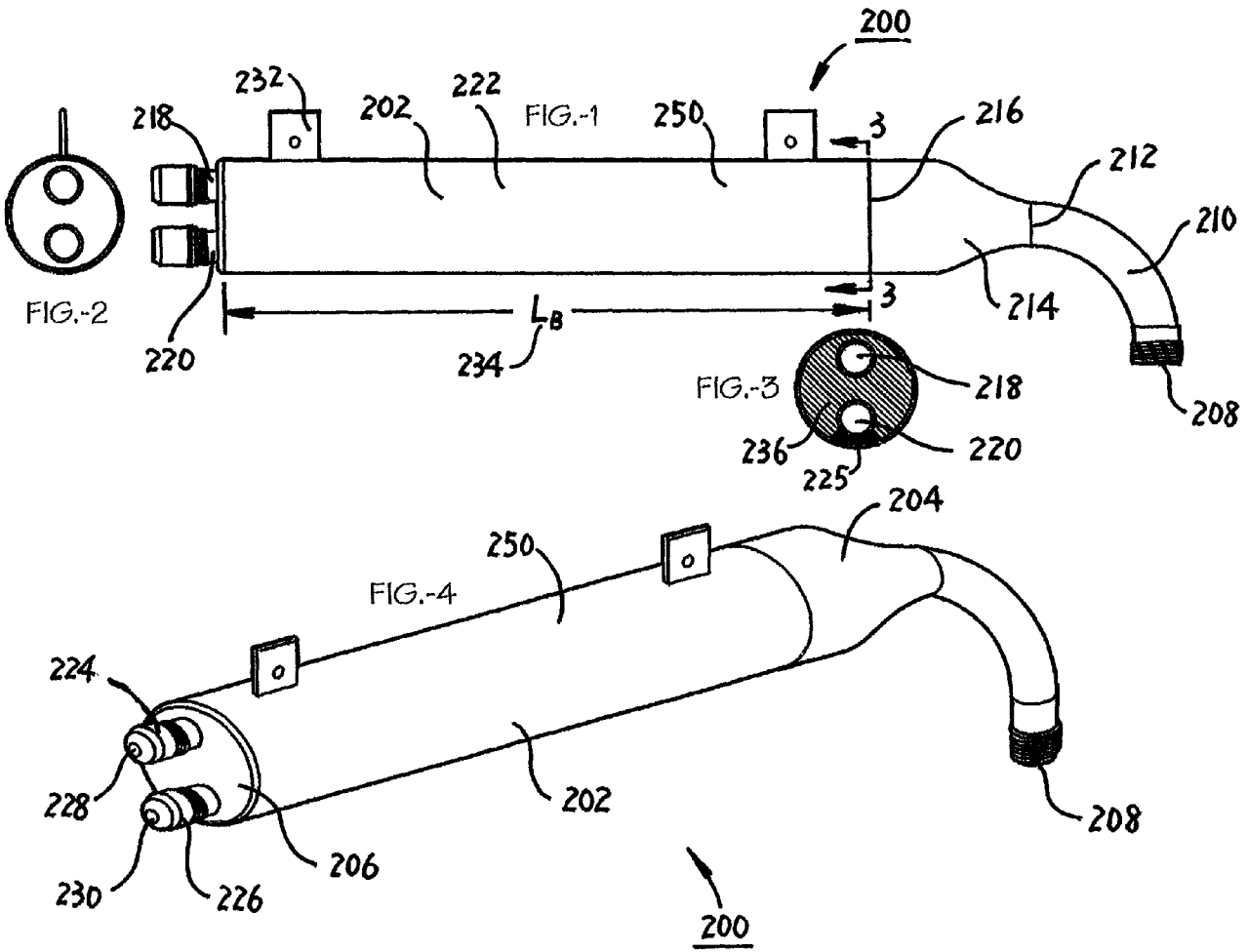
FIG. 1 is a schematic side elevational view of a splitter manifold.
FIG. 2 is an end plan view of the splitter manifold shown in FIG. 1.
FIG. 3 is a cross sectional view of the splitter manifold taken along lines 3-3.
FIG. 4 is a schematic perspective view of the splitter manifold depicted in FIG. 1.
Figure 5:
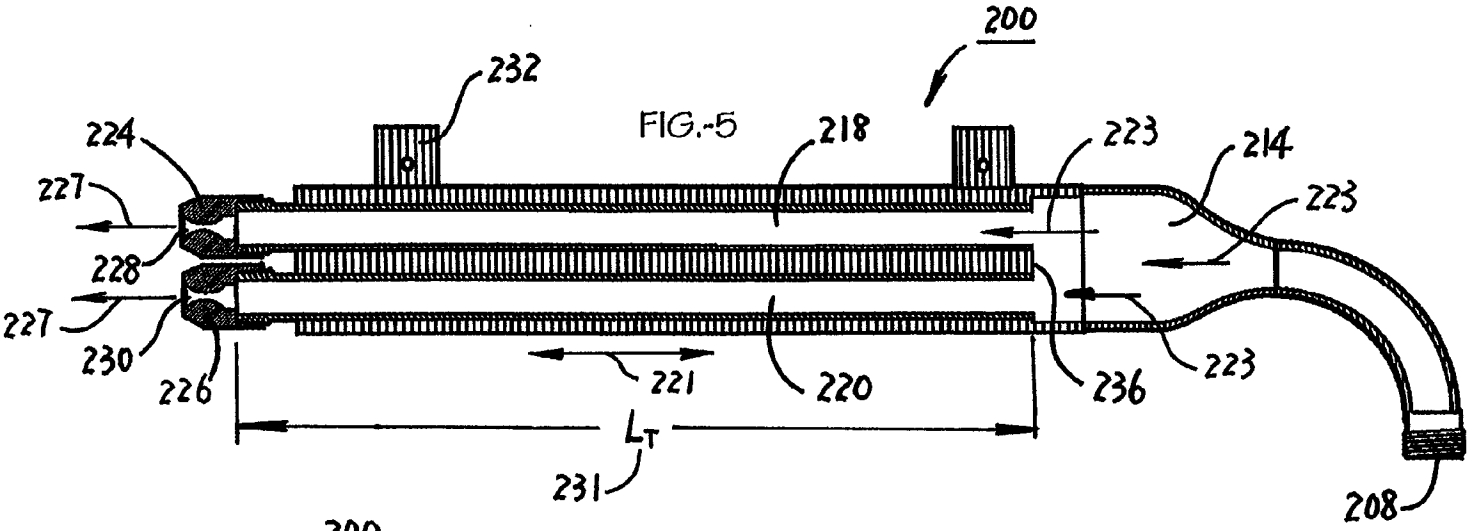
FIG. 5 is a schematic partial cross sectional view of the splitter manifold shown in FIG. 1 showing the first and second pre-nozzles.
Figure 6:
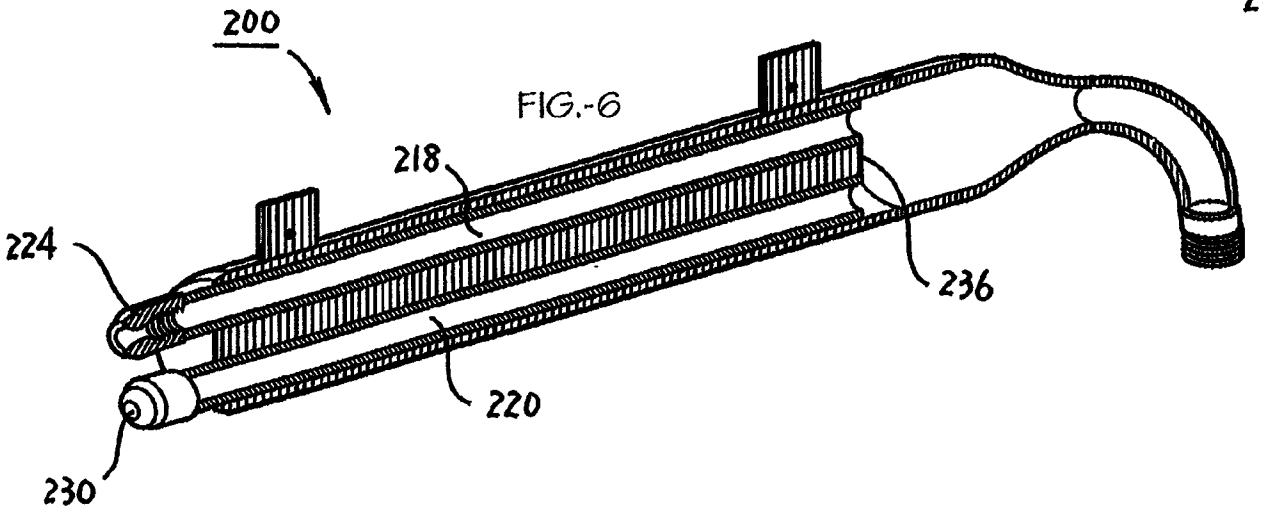
FIG. 6 is a schematic perspective partial cross sectional view of the splitter manifold shown in FIG. 1.

Referring now to FIGS. 5 and 6 the reader will note that first passageway 218 and second passageway 220 run longitudinally along the inside of body 250. Compressed air enters the passageways roughly at baffle 236 and exists the passageway by travelling through first manifold pre-nozzle 224 and second manifold pre-nozzle 226 before exiting out of first outlet 228 and second outlet 230. Optionally the passageways 218, 220 make contact with the body 250 at a contact area 225 which runs along the length of each passageway. This contact will depend upon the peak temperature reached by the body during operation.

Referring now to FIG. 7 which is a schematic of a twin wet abrasive blasting system 100 and includes two wet blasters namely first wet blaster 102 and second wet blaster 104.

Typically a wet blaster will include the following components as by way of example with first wet blaster 102 namely a pot 316 which holds an abrasive mixture 314 of water 310 and an abrasive such as sand, garnet etc.

Additional water 312 may be added to abrasive mixture 314 which passes past pinch valve 318 and into wand 308.

First air conduit 302 communicates compressed air 304 through an air valve 306 and on through to wand 308 where it picks up and entrains abrasive mixture 314 and exits under high pressure and speed at first exit nozzle 320 and in the case of second blaster 104 at second exit nozzle 322.

Please note that like numbers are used to denote like items in both first wet blaster 102 and second wet blaster 104.

For practical purposes first and second wet blasters 102 and 104 are essentially the same for the purpose of this example however it is possible that the two blasters may be configured somewhat differently and have differing sizes of exit nozzles.

Feeding compressed air to first wet blaster 102 and second wet blaster 104 is a single air compressor 106 which communicates and directs compressed air under high pressure and speed to the splitter manifold 200 which has been previously detailed.

In Use

Splitter manifold 200 receives compressed air from air compressor 106 at inlet 208 and communicates the compressed air via inlet pipe 210 to an expansion chamber 214 which allows the compressed air to expand.

In this example we are showing the housing 202 and body 250 and expansion chamber to be cylindrical in nature however other variations and shape are possible.

Expansion chamber 214 has an inlet diameter Di 212 and an expanded diameter De 216.

The air is directed to flow through first and second passageways 218 and 220 out through the outlet end 206 via a first manifold pre-nozzle 224 and a second manifold pre-nozzle 226 and eventually out first outlet 228 and second outlet 230 which feed first air conduit 302 and second air conduit 303 respectively.

The orifice diameter of first manifold pre-nozzle 224 is equivalent to or smaller than the orifice of first exit nozzle 320 similarly the orifice diameter of second manifold pre-nozzle 226 is similar to or smaller than the orifice diameter of second exit nozzle of 322.

In this manner when the flow at first exit nozzle 320 for example is cut off the airflow at second exit nozzle 322 is disturbed minimally due to the dampening effect of the pre-nozzling of first manifold pre-nozzle 224 and second manifold pre-nozzle 226.

Furthermore body 250 of splitter manifold 200 has a certain length Lb 234 in order to dissipate a significant amount of heat which is generated due to the expansion and compression of the compressed air through the splitter manifold 200.

Length Lb 234 is at least five times the inlet diameter Di 212 and preferable at least ten times the inlet diameter Di 212.

In the current state of the art generation of heat is an issue with splitting air flows out of a high pressure and volume air compressors such as air compressor 106.

It should be apparent to persons skilled in the arts that various modifications and adaptation of this structure described above are possible without departure from the spirit of the invention the scope of which defined in the appended claim.

I claim:

1. In combination a splitter manifold and at least two wet abrasive blasters connected to the splitter manifold by individual air conduits:

a) the splitter manifold receiving compressed air from a source of compressed air and splitting an inlet air flow among a least two passageways defined within the splitter manifold;

b) each passageway including a pre-nozzle proximate an outlet end defining at least two compressed air outlets each having a defined cross sectional area;

c) the splitter manifold communicating air through the outlets to the corresponding individual air conduits which extend from the outlets to the wet abrasive blasters to separately feed compressed air and entrained wet abrasive to the at least two wet abrasive blasters respectively;

d) wherein the at least two wet abrasive blasters each include an exit nozzle which is substantially the same or smaller in cross sectional area than the corresponding pre-nozzle.

e) wherein each air conduit includes an air valve between one of the air outlets and one of the wet abrasive blasters; and includes a connection to one of at least two sources of wet abrasive mixture between the air valve and the wet abrasive blaster.

2. The combination claimed in claim 1 wherein the splitter manifold includes a cylindrical inlet expansion chamber at an inlet end for communicating compressed air to the passageways, the expansion chamber including an inlet diameter Di and an expanded diameter De wherein De substantially ≥2×Di.

3. The combination claimed in claim 2 wherein the expansion chamber further includes a baffle for directing the air flow into the passageways.

4. The combination claimed in claim 2 wherein the passageways are tubular and have length $L_T$ such that length $L_T$ is substantially ≥5 Di.

5. The combination claimed in claim 2 wherein the passageways are tubular and have length $L_T$ such that length $L_T$ is substantially ≥10 Di.

6. The combination claimed in claim 1 wherein the passageways are tubular and oriented along a longitudinal direction such that air flow through the passageways and inlet air flow and outlet air flow are all oriented along a longitudinal direction.

7. The combination claimed in claim 1 wherein the splitter manifold includes a body for housing the passageways with an expansion chamber attached at an inlet end and the body terminating at an outlet end.

8. The combination claimed in claim 7 wherein the splitter manifold includes a tubular body for housing the passageways with a tubular expansion chamber attached at an inlet end and the body terminating at an outlet end, the body oriented along a longitudinal direction.

9. The combination claimed in claim 7 wherein the passageways make contact with the body at a contact area which runs along the length of each passageway.

10. A twin wet abrasive blasting system comprising;

a) a splitter manifold receiving compressed air from a source of compressed air;

b) the splitter manifold includes at least two passageways, each passageway receiving compressed air at an inlet end and terminating at a manifold pre-nozzle;

c) the splitter manifold communicating air through the passageways to corresponding air conduits which extend individually from separate outlets of the splitter manifold to individual wet blasters to separately feed compressed air and entrained wet abrasive to at least two wet blasters respectively;

d) wherein the blasters each include an exit nozzle, wherein each exit nozzle is substantially the same cross sectional area or smaller in area than the pre-nozzles respectively.

e) wherein each air conduit includes an air valve between one of the air outlets and one of the wet abrasive blasters; and includes a connection to one of at least two sources of wet abrasive mixture between the air valve and the wet abrasive blaster.

11. The twin wet abrasive blasting system claimed in claim 10 wherein the splitter manifold is tubular and includes an inlet having an inlet diameter Di.

12. The twin wet abrasive blasting system claimed in claim 11 wherein the inlet is connected to an expansion chamber with an expanded diameter De at least two times the inlet diameter, the expansion chamber communicates compressed air from the inlet to the passageways.

13. The twin wet abrasive blasting system claimed in claim 11 wherein the passageways lengths Lt are each at least five times the inlet diameter.

14. The twin wet abrasive blasting system claimed in claim 11 wherein the passageways lengths Lt are eachs at least ten times the inlet diameter.

15. The twin wet abrasive blasting system claimed in claim 11 wherein the splitter manifold includes a body for housing the passageways.

16. The twin wet abrasive blasting system claimed in claim 15 wherein the body length is at least five times the inlet diameter.

17. The twin wet abrasive blasting system claimed in claim 15 wherein the body length is at least ten times the inlet diameter.

18. A wet abrasive blasting system comprising:

a splitter manifold that includes a housing having an inlet end, an outlet end, an inlet located at the inlet end for receiving compressed air from a source of compressed air, first and second outlets located at the outlet end, an expansion chamber connected to the inlet, first and second passageways extending from the expansion chamber to the first and second outlets, respectively, a baffle for directing air flow from the explosion chamber into the first and second passageways, a first prenozzle proximate the first outlet, and a second prenozzle proximate the second outlet;

a first wet abrasive blaster connected to a source of wet abrasive material and having a first exit nozzle which has a cross sectional area equal to or less than a cross sectional area of the first prenozzle;

a second wet abrasive blaster connected to a source of wet abrasive material and having a second exit nozzle which has a cross sectional area equal to or less than a cross sectional area of the second prenozzle;

a first air conduit connected between the first outlet and the first wet abrasive blaster; and a second air conduit connected between the second outlet and the second wet abrasive blaster.

19. The system claimed in claim 18 wherein the expansion chamber includes an inlet diameter Di and an expanded diameter De wherein De substantially ≥2×Di.

20. The system claimed in claim 19 wherein the passageways are tubular and have length $L_T$ such that length $L_T$ is substantially ≥5 Di.

21. The system claimed in claim 19 wherein the passageways are tubular and have length $L_T$ such that length $L_T$ is substantially ≥10 Di.

22. The system claimed in claim 18 wherein the passageways are tubular and oriented along a longitudinal direction such that air flow through the passageways and inlet air flow and outlet air flow are all oriented along a longitudinal direction.

23. The system claimed in claim 18 wherein the splitter manifold includes a body for housing the passageways with an expansion chamber attached at an inlet end and the body terminating at an outlet end.

24. A wet abrasive blasting system comprising;

a splitter manifold receiving compressed air from a source of compressed air, wherein the splitter manifold includes first and second passageways for receiving compressed air at an inlet end and terminating at first and second manifold pre-nozzles adjacent first and second outlets, respectively;

first and second wet abrasive blasters including first and second exit nozzles, respectively, wherein the first and second exit nozzles have substantially the same cross sectional area or smaller in area than the pre-nozzles respectively;

first and second air conduits which feed compressed air from the first and second outlets of the splitter manifold to the first and second wet abrasive blasters, respectively, the first and second conduits including first and second air valves;

a first wet abrasive source connected to the first air conduit between the first air valve and the first wet abrasive blaster; and a second wet abrasive source connected to the second conduit between the second air valve and the second wet abrasive blaster.

25. The wet abrasive blasting system claimed in claim 24 wherein the splitter manifold is tubular and includes an inlet having an inlet diameter Di.

26. The wet abrasive blasting system claimed in claim 25 wherein the inlet is connected to an expansion chamber with an expanded diameter De at least two times the inlet diameter, the expansion chamber communicates compressed air from the inlet to the first and second passageways.

27. The wet abrasive blasting system claimed in claim 25 wherein the passageways lengths Lt are each at least five times the inlet diameter.

28. The wet abrasive blasting system claimed in claim 25 wherein the passageways lengths Lt are eachs at least ten times the inlet diameter.

29. The wet abrasive blasting system claimed in claim 25 wherein the splitter manifold includes a body for housing the passageways.

30. The wet abrasive blasting system claimed in claim 29 wherein the body length is at least five times the inlet diameter.

31. The wet abrasive blasting system claimed in claim 29 wherein the body length is at least ten times the inlet diameter.

* * * * *